US007003904B2

(12) United States Patent
Leitner

(10) Patent No.: US 7,003,904 B2
(45) Date of Patent: Feb. 28, 2006

(54) BOOTS WITH STEP-IN AND STEP-OUT, E.G. SPORTS BOOTS, IN PARTICULAR SKI BOOTS

(75) Inventor: Johann Leitner, Bichlbach (AT)

(73) Assignee: Aulei Leitner & Auer Oeg, Steinach Am Brenner (AT)

( * ) Notice: Subject to any disclaimer, the term of this patent is extended or adjusted under 35 U.S.C. 154(b) by 0 days.

(21) Appl. No.: 10/961,524

(22) Filed: Oct. 7, 2004

(65) Prior Publication Data

US 2005/0126048 A1 Jun. 16, 2005

Related U.S. Application Data

(63) Continuation of application No. PCT/AT03/00084, filed on Mar. 25, 2003.

(30) Foreign Application Priority Data

Apr. 25, 2002 (AT) ..... A 639/2002

(51) Int. Cl.
*A43B 11/00* (2006.01)
*A43B 5/04* (2006.01)

(52) U.S. Cl. ..... 36/138; 36/117.1; 36/117.6; 36/117.8

(58) Field of Classification Search ..... 36/117.1, 36/138, 117.8, 117.6, 117.7
See application file for complete search history.

(56) References Cited

U.S. PATENT DOCUMENTS

| | | | | |
|---|---|---|---|---|
| 588,156 | A * | 8/1897 | Lewis | 36/138 |
| 738,851 | A * | 9/1903 | Scism | 36/138 |
| 2,285,751 | A * | 6/1942 | Tamaki | 36/138 |
| 2,446,777 | A * | 8/1948 | Menenko | 36/138 |
| 3,261,114 | A * | 7/1966 | Saunders | 36/138 |
| 3,643,350 | A * | 2/1972 | Paoletta et al. | 36/138 |
| 3,798,802 | A * | 3/1974 | Saunders | 36/138 |
| 3,936,959 | A * | 2/1976 | Hanson et al. | 36/117.6 |
| 4,281,468 | A | 8/1981 | Giese | |
| 5,343,640 | A * | 9/1994 | Mattiuzzo et al. | 36/117.1 |
| 6,519,877 | B1 * | 2/2003 | Oetting et al. | 36/117.1 |

FOREIGN PATENT DOCUMENTS

| | | |
|---|---|---|
| CH | 263615 | 12/1949 |
| DE | 436020 | 10/1926 |
| DE | 1941258 | 2/1971 |
| EP | 0839464 | 5/1998 |
| GB | 2041721 | 9/1980 |

* cited by examiner

*Primary Examiner*—Anthony Stashick
(74) *Attorney, Agent, or Firm*—Martin Fleit; Paul D. Bianco; Fleit Kain Gibbons Gutman Bongini & Bianco P.L.

(57) ABSTRACT

The combination of a boot having a boot shell with a heel region and a step-in step-out aid having an elevated position and an inserted position cooperating with the boot shell, wherein the aid is at least one elongated heel wedge displaceably mounted in the heel region of the boot shell. The aid in its elevated position protrudes out of the boot shell, and in its inserted position at least partially fills the space between the boot shell and a person's heel that has been inserted into the boot shell.

11 Claims, 2 Drawing Sheets

BOOTS WITH STEP-IN AND STEP-OUT, E.G. SPORTS BOOTS, IN PARTICULAR SKI BOOTS

RELATED APPLICATION

This application is a continuation of International Application PCT/AT03/00084, filed Mar. 25, 2003, the contents of which are here incorporated by reference in their entirety. Applicant claims the benefit of 35 USC Section 120.

BACKGROUND OF THE INVENTION

1. Field of the Invention

The invention relates to a boots having a step-in and step-out aid, e.g. sports boots, in particular ski boots, and has as its object to facilitate not only stepping into the boot, but also stepping out of the boot, and moreover, to ensure a good fit of the sports-person's foot in the respective boot. This includes all types of sports boots, such as, e.g. cross-country skiing, alpine skiing, ski touring, snowboarding, roller skating, inline skating, ice hockey, ice skating, alpine, hiking, and climbing boots and the like.

2. Prior Art

Known sports boots used for the purposes mentioned, in particular ski boots, have relatively large openings in the region of the calf, which often extend as far as to the heel, since particularly when using plastics materials, there result very stiff shells which do promote the traveling properties of the boot, yet disadvantageously allow the foot only a small radius for stepping into the boot. The cavities forming thereby adversely affect the fit in the sports-person's heel region.

SUMMARY OF THE INVENTION

The invention has as its object to provide measures by which the problem mentioned will effectively be solved. For this purpose, according to the invention, a heel wedge displaceable in terms of height is provided in the heel region of the sports boot, which wedge protrudes out of the boot in its elevated position and guides the heel into the boot, and in its inserted position fills the free space in the boot.

According to a further feature of the invention, an inner recess is provided in the heel part of the sports boot, between its upper end as far as to approximately half of the calf section, in which recess the heel wedge is vertically movable. This recess serves as a guide for the heel wedge.

According to a further feature of the invention, in the region of the heel wedge, the sports boot is provided with a means for fixing the heel wedge.

When stepping into the boot, after having loosened the fixing device, the heel wedge is pulled upwards from a normal position in the boot, sufficient space being provided between the sports person's heel and calf so as to ensure an easy and comfortable stepping into the boot, whereupon the heel wedge is pressed downwards into the boot and the fixing device is tightened. By this, an extremely good fit of the heel is achieved.

BRIEF DESCRIPTION OF THE DRAWINGS

Further features of the invention will be explained in more detail by way of the drawings in which an exemplary embodiment of the subject matter of the invention is illustrated.

DETAILED DESCRIPTION OF PREFERRED EMBODIMENTS OF THE INVENTION

Figure 1:
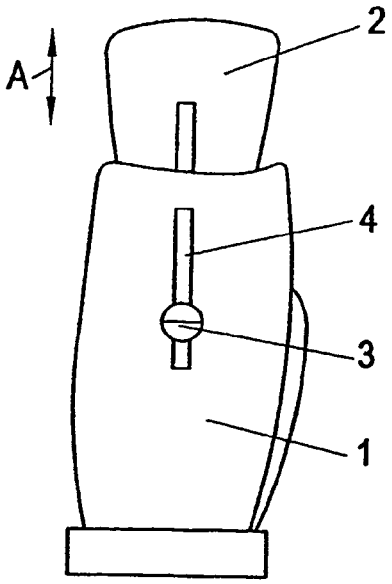
FIG. 1 shows a rear view of the lower shell of a ski boot.
Figure 2:
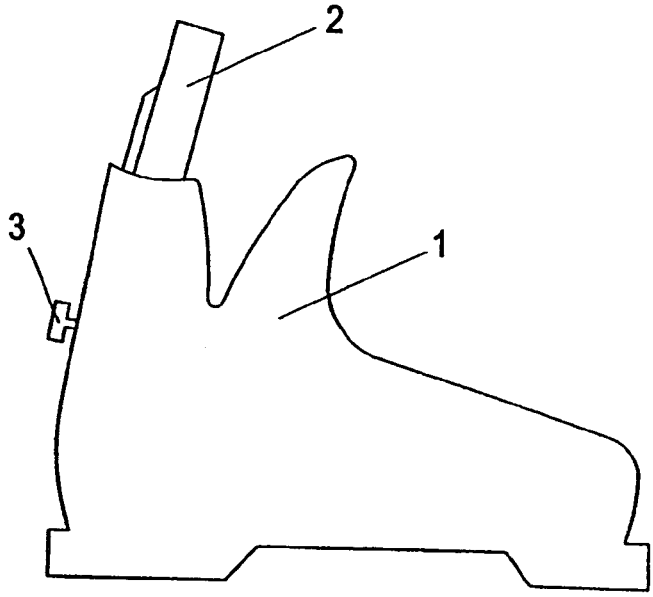
FIG. 2 shows a side view of the same.
Figure 3:
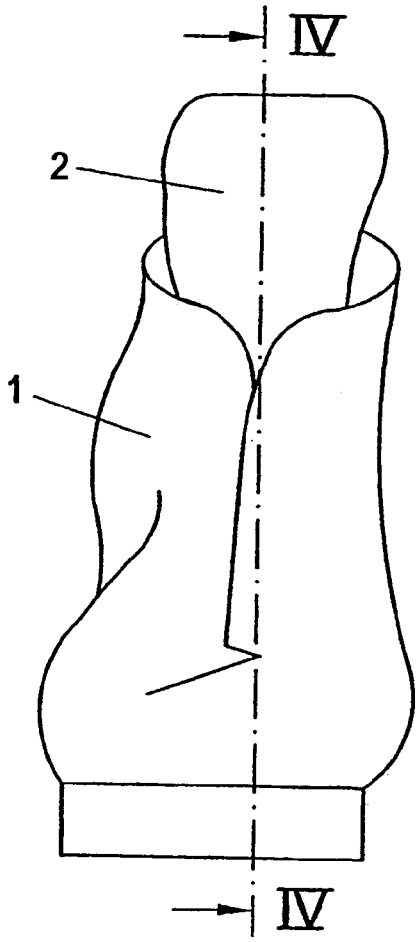
FIG. 3 shows a front view of the same.

In FIG. 1, the lower shell of a ski boot is denoted by 1 in which a heel wedge 2 is inserted which is displaceable in terms of height in the direction of the double arrow A and guided in a shell slit 4. In the present case, the heel wedge 2 can be fixed at any level by a fixing element 3, e.g. a fixing screw.

Figure 5:
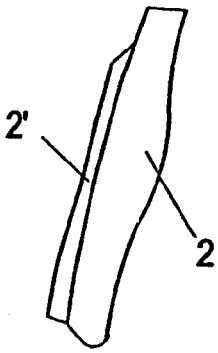
FIG. 5 shows a side view of the heel wedge.
Figure 6:
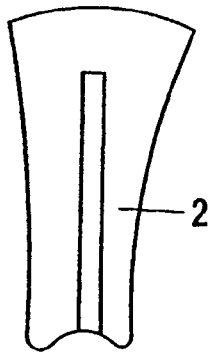
FIG. 6 shows a rear view of the same.
Figure 7:
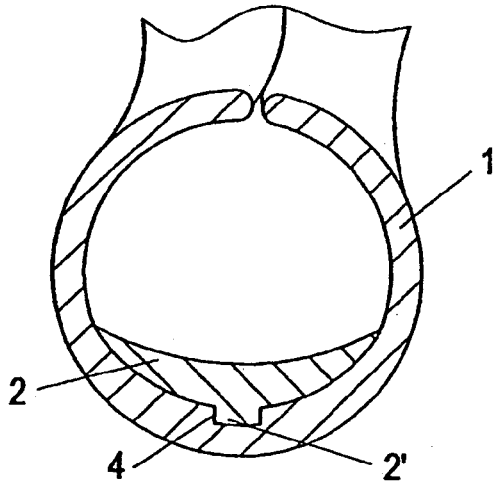
FIG. 7 shows a section according to line VII—VII of FIG. 4.

To guide the heel wedge 2 in the shell slit 4, the heel wedge 2 is provided with a guiding web 2', as can be seen in FIG. 5.

Figure 4:
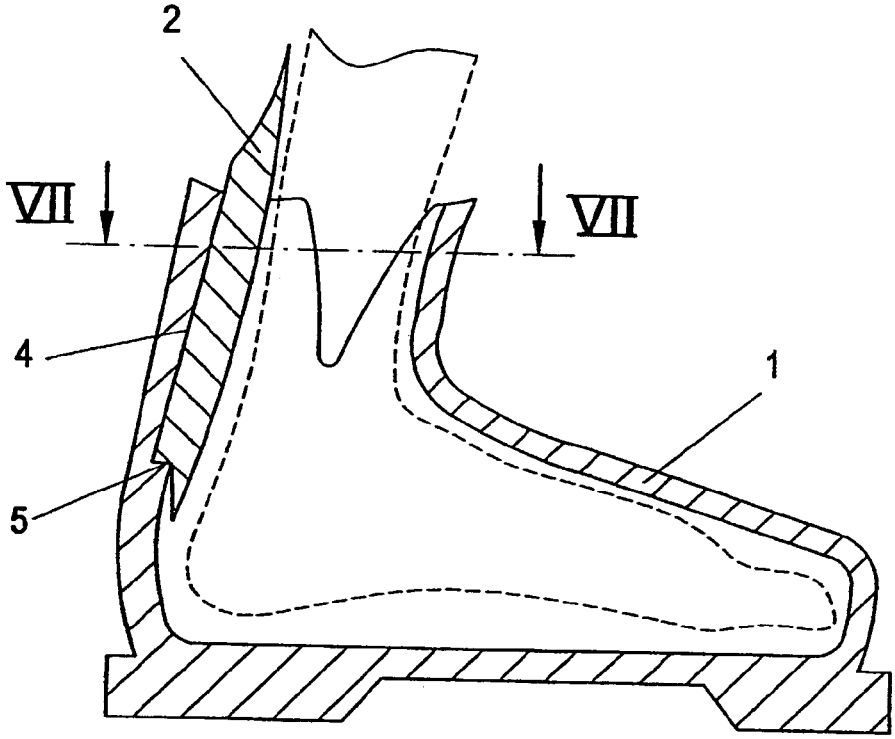
FIG. 4 shows a longitudinal section according to line IV—IV of FIG. 3.

For stepping into the ski boot, the heel wedge 2 is pulled up into its uppermost position in the shell slit 4 so that the skier can comfortably step in, whereupon the heel wedge 2 is shifted into its lowermost position indicated in FIG. 4, in which the heel wedge 2, by means of a stop 5, abuts against a shoulder of the shell 1, which shoulder projects towards the boot interior. By this measure, the skier's foot will become tightly seated in the ski boot, as shown in broken lines in FIG. 4.

Of course, within the scope of the invention also several heel wedges may be arranged adjacently, wherein the shape of the heel wedge 2 can be designed according to the respective need and purpose.

The inventive measure with a heel wedge 2 can be applied in any type of boots, in particular those with a high shaft, e.g. ski boots, hiking boots and the like, in which the user with a high instep can step into the boot only with difficulty, if the latter is to ensure a tight fit, or requires a deep opening at the side of the instep which, in turn, can prevent the entry of snow and moisture only to an insufficient extent.

What is claimed is:

1. The combination of a boot having a boot shell with a heel region and a step-in step-out aid having an elevated position and an inserted position cooperating with the boot shell, wherein the aid is comprised of at least one elongated heel wedge displaceably mounted in the heel region of the boot shell, said aid in its elevated position protruding out of the boot shell, and in its inserted position at least partially filling the space between the boot shell and a person's heel that has been inserted into the boot shell, wherein the boot shell defines an inner recess, extending vertically in the heel part of the boot shell, the heel wedge being guided in the inner recess, wherein the inner recess is defined by one of a groove and a slot in the boot shell.

2. The combination according to claim 1, the heel wedge has a guiding web that is guided in the inner recess.

3. The combination according to claim 1, wherein a lock element is provided for fixing the heel wedge relative to the inner recess.

4. The combination according to claim 1, wherein the boot shell defines a stop for establishing the inserted position of the heel wedge.

5. The combination according to claim 3, wherein the lock element is a fixing screw.

6. The combination of a boot having a boot shell with a heel region and a step-in step-out aid having an elevated position and an inserted position cooperating with the boot shell, wherein the aid is comprised of at least one elongated heel wedge displaceably mounted in the heel region of the boot shell, said aid in its elevated position protruding out of the boot shell, and in its inserted position at least partially filling the space between the boot shell and a person's heel that has been inserted into the boot shell, wherein an inner recess, preferably in the form of a vertical shell slit, is provided in the heel part of the boot between its upper end as far as to approximately half of its calf section, the heel wedge being guided in this recess.

7. The combination according to claim 6, characterized in that the heel wedge is guided in the shell slit by a guiding web.

8. The combination according to claim 6, characterized in that the shell slit is provided in the middle region of the boot heel.

9. The combination according to claim 6, characterized in that the heel wedge and the boot shell are provided with a stop for defining the inserted position of the heel wedge.

10. The combination of a boot having a boot shell with a heel region and a step-in step-out aid having an elevated position and an inserted position cooperating with the boot shell, wherein the aid is comprised of at least one elongated heel wedge displaceably mounted in the heel region of the boot shell, said aid in its elevated position protruding out of the boot shell, and in its inserted position at least partially filling the space between the boot shell and a person's heel that has been inserted into the boot shell, wherein a means for fixing the heel wedge, preferably at any level, is provided.

11. The combination according to claim 10, characterized in that the means for fixing the heel wedge is designed as a fixing screw.

* * * * *